US008243010B2

(12) United States Patent
Lee et al.

(10) Patent No.: US 8,243,010 B2
(45) Date of Patent: Aug. 14, 2012

(54) LIQUID CRYSTAL DISPLAY DEVICE AND DRIVING METHOD THEREOF FOR IMPROVING A CONTRAST RATIO

(75) Inventors: Tae Wook Lee, Gyeonggi-do (KR); Jin Chul Choi, Gyeonggi-do (KR); Ji Kyoung Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 445 days.

(21) Appl. No.: 12/546,023

(22) Filed: Aug. 24, 2009

(65) Prior Publication Data

US 2010/0085374 A1 Apr. 8, 2010

(30) Foreign Application Priority Data

Oct. 7, 2008 (KR) ..... 10-2008-0097931

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 2005/0057486 | A1* | 3/2005 | Aoki et al. | 345/102 |
| 2006/0109234 | A1* | 5/2006 | Hong et al. | 345/102 |
| 2006/0164379 | A1* | 7/2006 | Oh et al. | 345/102 |
| 2007/0222740 | A1* | 9/2007 | Hanada | 345/102 |
| 2008/0186272 | A1* | 8/2008 | Huang et al. | 345/102 |
| 2008/0252666 | A1* | 10/2008 | Chen et al. | 345/690 |

* cited by examiner

*Primary Examiner* — Chanh Nguyen
*Assistant Examiner* — Jonathan Blancha
(74) *Attorney, Agent, or Firm* — Morgan, Lewis & Bockius LLP

(57) ABSTRACT

An LCD device with an improved contrast ratio and a reduced electric power consumption and a driving method thereof are disclosed. The LCD device and the driving method thereof generate a data modulation control signal using single frame image data to be displayed on a liquid crystal panel, and then generating a plurality of modulated local dimming control signals for a plurality of divisional regions of the divided single frame image data. A modulated data, in which the single frame image data is compensated with the data modulation control signal is generated and applied to the liquid crystal panel. A plurality of driver signals each corresponding to the modulated local dimming control signals are applied to the blocks of a backlight unit. The divisional regions are opposite to the blocks, respectively.

11 Claims, 6 Drawing Sheets

| | | | | | |
|---|---|---|---|---|---|
| BLK[1,1] | BLK[1,2] | BLK[1,3] | BLK[1,4] | ··· | BLK[1,m] |
| BLK[2,1] | | | | | |
| BLK[3,1] | | | | | |
| ⋮ | | ⋮ | | ··· | |
| BLK[n,1] | | | | | BLK[n,m] |

LIQUID CRYSTAL DISPLAY DEVICE AND DRIVING METHOD THEREOF FOR IMPROVING A CONTRAST RATIO

CROSS-REFERENCE TO RELATED APPLICATION

This application claims priority under 35 U.S.C. 119 to Korean Patent Application No. 10-2008-0097931, filed on Oct. 7, 2008, which is hereby incorporated by reference in its entirety.

BACKGROUND

1. Field of the Disclosure

This disclosure relates to a liquid crystal display device, and more particularly to a liquid crystal display device with an improved contrast ratio and a reduced electric power consumption, and a driving method thereof.

2. Description of the Related Art

As the information society grows, flat display devices capable of displaying information have been widely developed. These flat display devices include liquid crystal display (LCD) devices, organic electro-luminescence display (OLED) devices, plasma display devices, and field emission display devices. Among the above display devices, LCD devices have the advantages that they are light, small, provide a low power drive and have a full color scheme. Accordingly, LCD devices have been widely used for mobile phones, navigation systems, portable computers, televisions and so on. An LCD device controls the transmittance of a liquid crystal on a liquid crystal panel, thereby displaying a desired image.

FIG. 1 is a block diagram schematically showing an LCD device of the related art. Referring to FIG. 1, the LCD device includes a timing controller 1, a gate driver 2, a data driver 3, a liquid crystal panel 4, a backlight controller 5, a backlight driver 6, and a backlight unit 7.

The timing controller 1 receives control signals including a vertical synchronous signal, a horizontal synchronous signal, a data enable signal, a data clock and others, together with a data signal from the exterior. From the vertical and horizontal synchronous signals, the data clock, and the data enable signal, the timing controller 1 generates first control signals for driving the gate driver 2 and second control signals for driving the data driver 3. Moreover, the timing controller 1 generates a backlight control signal for controlling the backlight controller 5.

The first control signals enable the gate driver 2 to apply scan signals to the liquid crystal panel 4. The second control signals enable the data driver 3 to convert the data signal into an analog data voltage and to apply the converted analog data voltage to the liquid crystal panel 4.

The backlight controller 5 generates a backlight drive signal in accordance with the backlight control signal and applies the backlight drive signal to the backlight driver 6. The backlight driver 6 supplies the backlight unit 7 with a drive voltage derived from the backlight drive signal. The backlight unit 7 irradiates a light corresponding to the drive voltage onto the liquid crystal panel 4.

The liquid crystal panel 4 displays an image according to the refractive index of the liquid crystal which is interposed between two substrates. More specifically, the refractive index of the liquid crystal is varied along with the drive voltage and a transmissive amount of light, which is transmitted through from the backlight unit 7, is adjusted in accordance with the refractive index of the liquid crystal, thereby displaying the image.

In general, the LCD device has been forcibly required to have a high contrast ratio which allows dark and bright regions in an image to be more darkly and brightly displayed, respectively. This results from the fact that the LCD device must have a higher contrast ratio in order to reproduce a more defined image.

However, since the related art backlight unit 7 is driven by a fixed backlight control signal, it is impossible to realize the high contrast ratio in the LCD device. This backlight driving system has been referred to as a "normal brightness control system".

Recently, a global brightness control system has been proposed which analyzes the image of a single frame and then controls the brightness and modulates the image according to the analyzed resultant. The global brightness control system can control the brightness for an image of a single frame, but cannot control brightness for a local image (i.e., a portion of the image). In other words, a local high contrast ratio cannot be obtained by the global brightness control system.

To address this matter, a local brightness control system has been proposed which divides a single frame image into a plurality of local images and controls the brightness corresponding to each of the divided local images. However, the local brightness control system has lower brightness than that of the normal brightness control system, in a middle/high gray level range of about 60~200.

In addition, all of the normal, global, and local brightness control systems force electric power consumption to be increased.

BRIEF SUMMARY

Accordingly, the embodiments of the present invention are directed to an LCD device and a driving method thereof that substantially obviate one or more of problems due to the limitations and disadvantages of the related art.

An object of the embodiments of the present invention is to provide an LCD device that unites the global and local brightness control systems in order to greatly improve the image brightness and greatly reduce the electric power consumption, along with a driving method thereof.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present invention, an LCD device includes: a liquid crystal panel including a plurality of pixels arranged in a matrix; a backlight unit divided into a plurality of blocks; a global brightness controller that generates a data modulation control signal using a single frame image data to be displayed on the liquid crystal panel; a local brightness controller that generates a plurality of modulated local dimming control signals for a plurality of divisional regions divided from the single frame image data; a data modulator that generates a modulated data from the single frame image data by using the data modulation control signal, and supplies the modulated data to the liquid crystal panel; and a backlight driver that supplies the blocks of the backlight unit with a plurality of driver signals which correspond to the plurality of modulated local dimming control signals respectively, wherein the plurality of divisional regions correspond to the plurality of blocks, respectively.

An LCD device driving method according to another general aspect of the present invention applies to a liquid crystal display device including a liquid crystal panel with a plurality of pixels arranged in a matrix and a backlight unit divided into a plurality of blocks. The method includes: generating a data modulation control signal using a single frame image data to be displayed on the liquid crystal panel; generating a plurality of modulated local dimming control signals for a plurality of divisional regions of the divided single frame image data; generating a modulated data from the single frame image data by using the data modulation control signal, and applying the modulated data to the liquid crystal panel; and supplying the blocks of the backlight unit with a plurality of driver signals which correspond to the plurality of modulated local dimming control signals respectively, wherein the plurality of divisional regions correspond to the plurality of blocks respectively.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
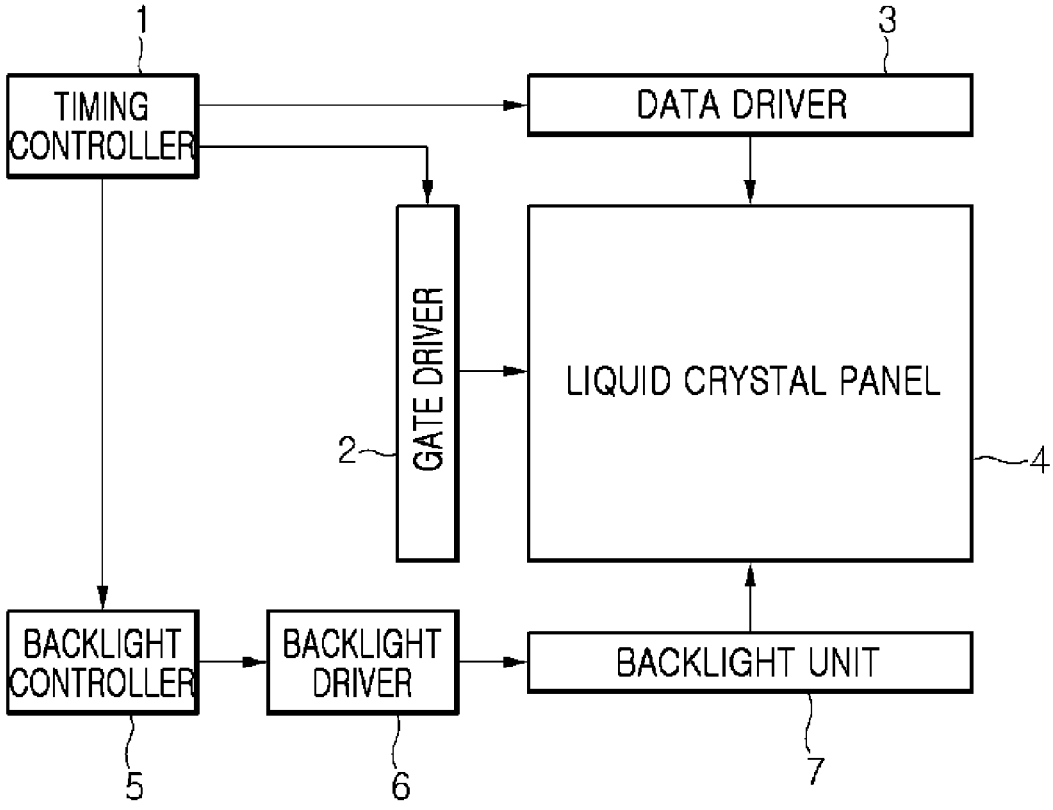
FIG.1 (Related Art)
FIG. 1 is a block diagram schematically showing an LCD device of related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
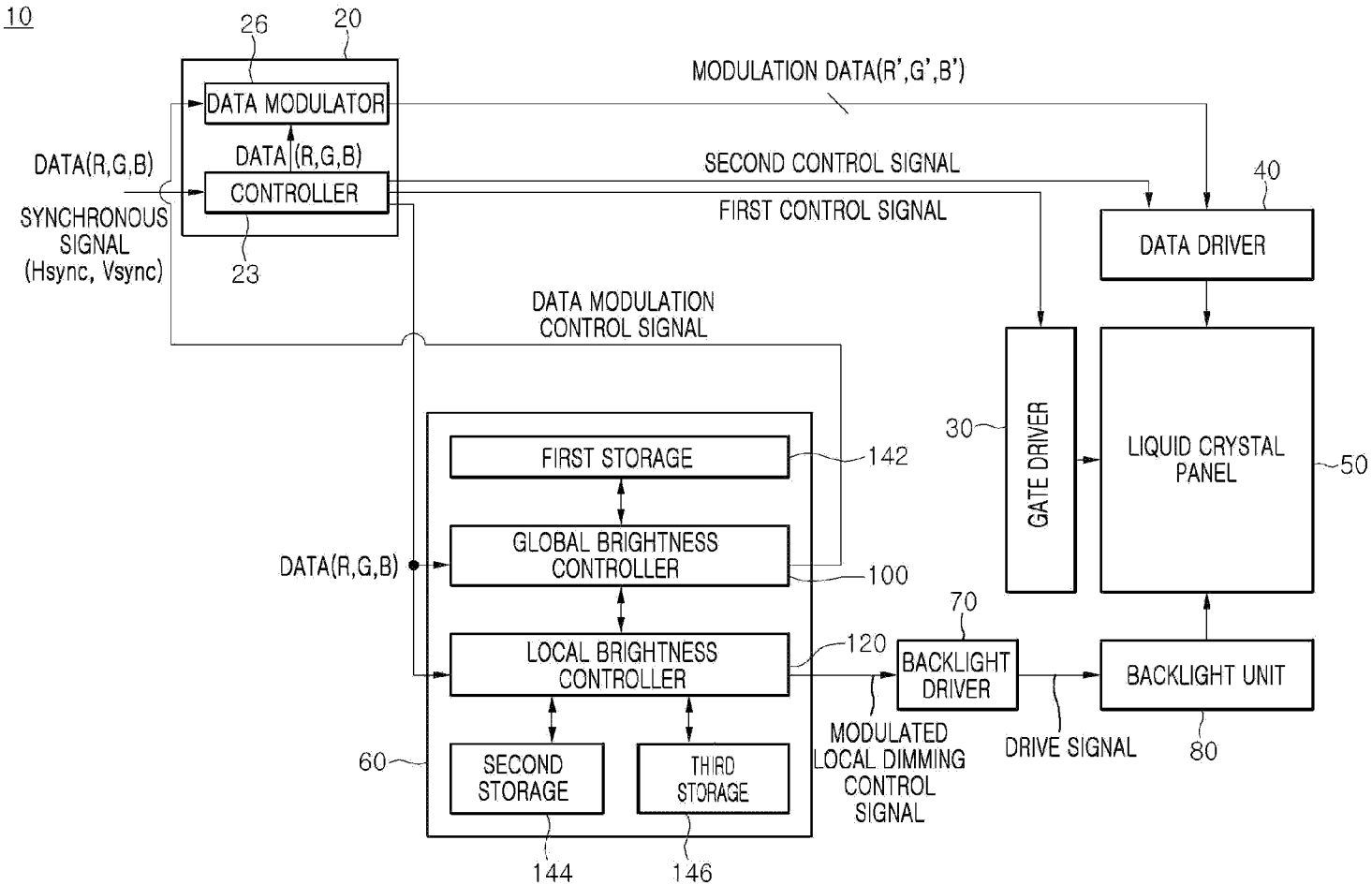
FIG. 2 is a block diagram schematically showing an LCD device according to an embodiment of the present disclosure.
Figure 3:
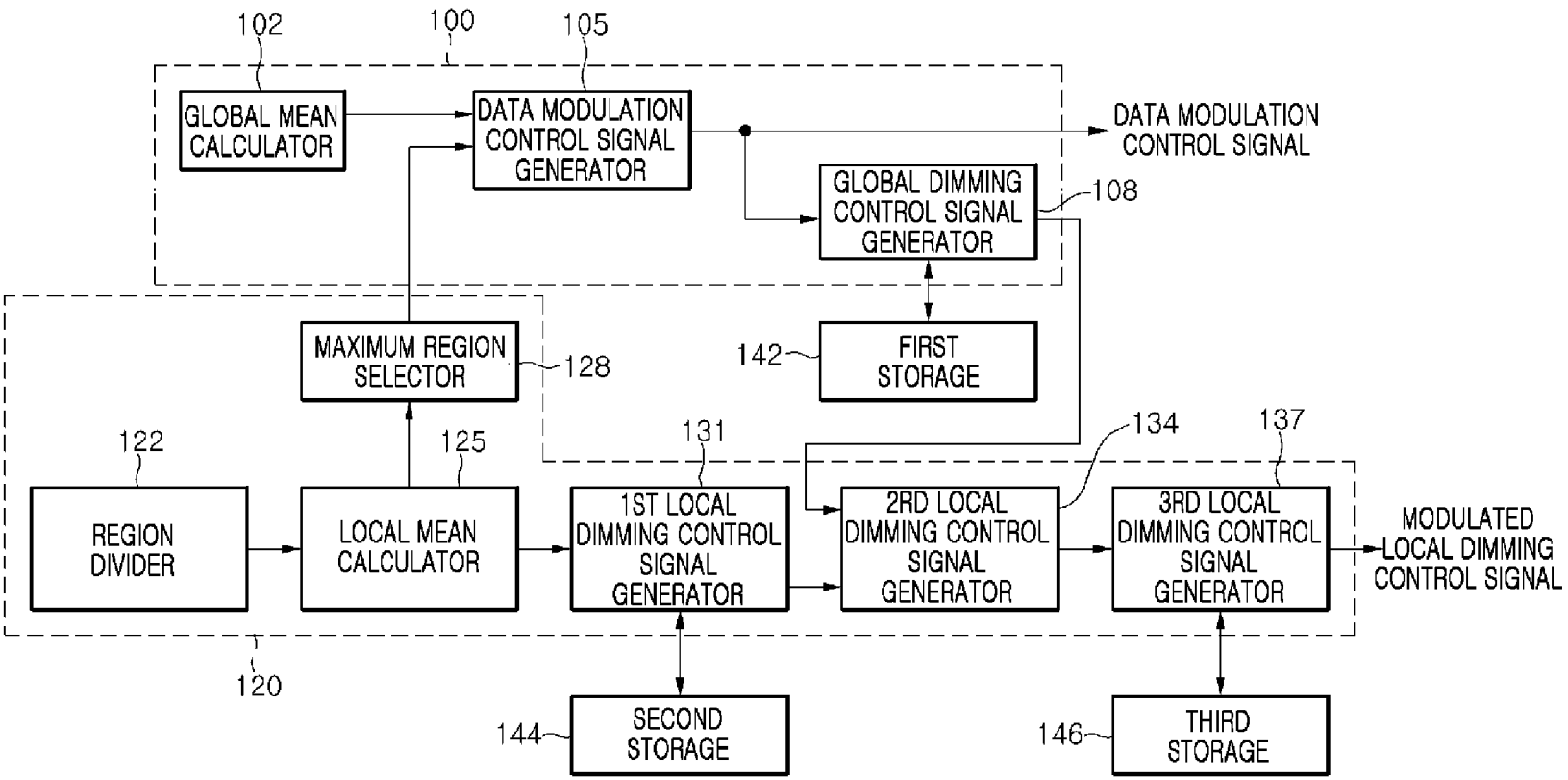
FIG. 3 is a block diagram showing in detail a backlight unit shown in FIG. 2.

FIG. 2 is a schematic block diagram showing an LCD device according to an embodiment of the present disclosure. FIG. 3 is a block diagram showing in detail the backlight controller shown in FIG. 2. Referring to FIG. 2, the LCD device 10 includes a timing controller 20, a gate driver 30, a data driver 40, a liquid crystal panel 50, a backlight controller 60, a backlight driver 70, and a backlight unit 80.

The liquid crystal panel 50 includes upper and lower substrates and a liquid crystal interposed between the substrates.

The lower substrate includes a plurality of gate lines and a plurality of data lines which are arranged crossing each other. A thin film transistor is disposed at the intersection of the gate and data lines. The thin film transistor is connected to a pixel electrode. The crossed gate and data lines define unit pixels on the lower substrate. Each of the unit pixels includes a thin film transistor and a pixel electrode.

The upper substrate includes red, green and blue color filters opposite to the respective pixels, a black matrix disposed between the color filters, and a common electrode disposed on the color filters and the black matrix. Such an upper substrate having a common electrode is applied to a liquid crystal panel of a TN (Twisted nematic) mode. Alternatively, the common electrode can be disposed on the lower substrate in case the liquid crystal panel 50 is in an in-plane switching mode.

Consequently, the liquid crystal panel 50 has a plurality of color pixels arranged in a matrix. These color pixels on the liquid crystal panel 50 may be responsive to respective red, green and blue data voltages so that the image of a single frame may be displayed.

The timing controller 20 receives image data R, G, and B of a single frame from an external source such as a video card. The timing controller 20 also receives a vertical synchronous signal Vsync, a horizontal synchronous signal Hsync, a data enable signal, a data clock, etc., for controlling image display, from the external source. This timing controller 20 includes a controller 23 and a data modulator 26.

The controller 23 generates first control signals for driving the gate driver 30 and second control signals for driving the data driver 40 from the vertical synchronous signal Vsync, the horizontal synchronous signal Hsync, the data clock, the data enable signal, and so on. The first control signals may include a gate start pulse GSP, a gate shift clock GSC, and a gate output enable signal GOE. The second control signals may include a source start pulse SSP, a source shift clock SSC, and a source output enable signal SOE. The controller 23 supplies the gate driver 30 with the first control signals and applies the second control signals to the data driver 40. Also, the controller 23 applies the image data R, G, and B to the data modulator 26 and the backlight controller 60.

The data modulator 26 modulates the image data R, G, and B applied from the controller 23 on the basis of a data modulation control signal applied from the backlight unit 60 to generate modulated data R', G', and B'. The modulated data R', G' and B' are then applied to the data driver 40.

The gate driver 30 responds to the first control signals and sequentially applies scan signals to the gate lines on the liquid crystal panel 50. As such, the thin film transistors of the pixels on the gate lines are sequentially turned on line by line.

The data driver 40 responds to the second control signals and converts the modulated data R', G', and B' into analog data voltages. The converted analog data voltages are applied to each pixel, in which the turned-on thin film transistor is disposed, on the respective gate line. The converted analog data voltage applied to each pixel together with a common voltage on the common electrode may vary the refractive index of the liquid crystal.

The backlight controller 60 includes a global brightness controller 100, a local brightness controller 120, and first to third storages 142, 144, and 146. The first storage 142 is connected to the global brightness controller 100, and the second and third storages 144 and 146 are connected to the local brightness controller 120.

The global brightness controller 100 includes a global mean calculator 102, a data modulation control signal generator 105, and a global dimming control signal generator 108. The local brightness controller 120 includes a region divider 122, a local mean calculator 125, a maximum region selector 128, and first to third local dimming control signal generators 131, 134, and 137. The global mean calculator 102, the data modulation control signal generator 105, and the global dimming control signal generator 108 included in the global brightness controller 100, as well as the region divider 122, the local mean calculator 125, the maximum region selector 128, and the first to third local dimming control signal generators 131, 134, and 137 included in the local brightness controller 120 are organically connected to one another. Therefore, the components of the global brightness controller 100 and the components of the local brightness controller 120 will be explained in parallel.

The global mean calculator 102 calculates a mean value for the image data R, G, and B of the single frame applied from the controller 23 of the timing controller 20. The image data R, G, and B of the single frame includes a plurality of pixel data. The pixel data includes a red sub-pixel data, a green sub-pixel data, and a blue sub-pixel data. Also, the global mean calculator 102 selects a maximum sub-pixel data which has the highest value among the red, green, and blue sub-pixel data included in each pixel. The selected maximum sub-pixel data will represent the respective pixel data. As a result, the arithmetic processing load of the global mean calculator 102 is decreased and the processing rate (or speed) is improved. The global mean calculator 102 obtains a mean value from a plurality of the selected sub-pixel data. The obtained mean value will be referred to as the "global mean value".

The region divider 122 divides the image data R, G, and B of a single frame applied from the controller 23 into separate regions corresponding to the blocks which are defined in the backlight unit 80. For example, if the backlight unit 80 is defined into 80 blocks, the single frame of image data R, G, and B may be divided into 80 divisional regions.

The local mean calculator 125 calculates a mean value for the plural maximum sub-pixel data selected in each divisional region. Each divisional region includes a plurality of pixel data, and each pixel data may consist of red, green, and blue sub-pixel data. Therefore, the selected maximum sub-pixel data becomes one sub-pixel, which has the highest value among the red, green, and blue sub-pixel data included in each pixel within each divisional region. Also, the selected maximum sub-pixel data represents the respective pixel data in the respective divisional region. In accordance therewith, the arithmetic processing load of the local mean calculator 125 is reduced and likewise its performing rate (or speed) is improved. In other words, the local mean calculator 125 takes the mean of the plural maximum sub-pixel data selected in each divisional region and obtains the mean value. The mean values obtained in divisional regions are provided as "local mean values".

The maximum region selector 128 selects the local mean value of a divisional region which has a maximum mean value among the local mean values obtained in the local mean calculator 125. The selected local mean value is provided as a "maximum local mean value".

The data modulation control signal generator 105 calculates the global mean value from the global mean calculator 102 and the maximum local mean value from the maximum region selector 128, and generates a data modulation control signal. The data modulation control signal may include a value which is obtained by dividing the global mean value with the maximum local mean value. The data modulation control signal is applied to the data modulator 26 of the timing controller 20.

The data modulator 26 modulates the image data R, G, and B applied from the controller 23 on the basis of the data modulation control signal output from the data modulation control signal generator 105 to a modulated data R', G', and B'. the modulated data R', G', and B' are applied to the data driver 40.

The modulated data R', G', and B' may become a value which is calculated by the data modulation control signal to be added to or subtracted from the image data R, G, and B. For example, if the data modulation control signal is "3", i.e., "00000011", the modulated data R', G', and B' can have a value determined when the data modulation control signal of "00000011" is added to the image data R, G, and B which is a digital signal. Consequently, the image data R, G, and B can vary according to the value of the data modulation control signal.

The first local dimming control signal generator 131 refers to a second dimming curve and generates first dimming control signals for the divisional regions corresponding to the local mean values of the divisional regions applied from the local mean calculator 125. The second dimming curve is determined in a table which uses the local mean value and the first local dimming control signal as input and output values, respectively, in order to control local brightness. This table including the second dimming curve may be stored in the second storage 144. In accordance therewith, when the local mean value for a divisional region is applied from the local mean calculator 125, the first local dimming control signal generator 131 can select a first local dimming control signal corresponding to the local mean value, as an output value. The first local dimming control signals may be generated by the number of blocks defined in the backlight unit 80.

The global dimming control signal generator 108 refers to a first dimming curve stored in the first storage 142. It generates a global dimming control signal corresponding to the data modulation control signal applied from the data modulation control signal generator 105. The first dimming curve is determined in a table which uses the data modulation control signal and the global dimming control signal as input and output values, respectively, in order to control global (or overall) brightness. The table for the first dimming curve is stored in the first storage 142. As such, the global dimming control signal generator 108 can select a global dimming control signal corresponding to the data modulation control signal, as an output value when the data modulation control signal is applied from the data modulation control signal generator 105. The global dimming control signal is generated one per image data R, G, and B of a single frame.

The second dimming control signal generator 134 takes the values of one global dimming control signal applied from the global dimming control signal generator 108 along with each of the first local dimming control signals applied from the first local dimming control signal generator 131, and generates a plurality of second local dimming control signals. Each of the second local dimming control signals can be obtained by performing a digital logic-AND operation (a digital logic-multiple arithmetic) on the global dimming control signal and each first local dimming control signal. For example, the global dimming control signal and the first local dimming control signals can be digital signals of 8 bits. When the digital logic-AND operation is performed on the global dimming control signal and the first local dimming control signal, the second dimming control signal can be provided with a value of 16 bits. In order to increase the processing rate (or speed) of the second local dimming control signal generator 134, only the value of 8 high-bits is selected from the value of 16 bits, without the value of 8 low-bits, as the second local dimming control signal.

More specifically, the second local dimming control signal for a first divisional region may be generated by performing the digital logic-AND operation on the global dimming control signal and the first local dimming control signal of the first divisional region. Also, the second local dimming control signal for a second divisional region can be obtained by performing the digital logic-AND operation on the global dimming control signal and the first local dimming control signal of the second divisional region. The second local dimming control signals for the rest of the divisional regions may be generated by repeatedly performing such a digital logic-AND operation.

The third local dimming control signal generator 137 refers to a third dimming curve stored in the third storage 146. It generates third local dimming control signals, for the divisional regions, corresponding to the second local dimming control signals of the divisional regions. Each of the third local dimming control signals can be referred to as a modulated local dimming control signal. The third dimming curve is provided in a table which has the values of the second and third local dimming control signals as input and output values, respectively, in order to control local brightness. The table including the third dimming curve may be stored in the third storage 146. The modulated local dimming control signals can be directly applied to the backlight driver 70 or converted into pulse-width-modulation (PWM) signals before being applied to the backlight driver 70.

Figures 4, 5:
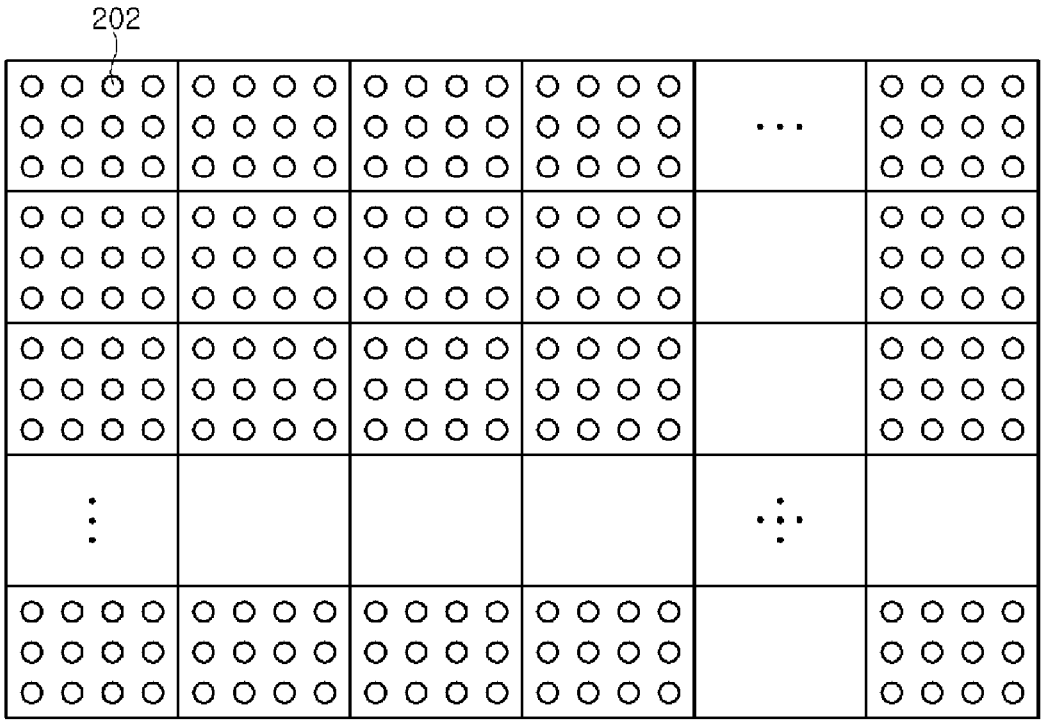
FIG. 4 is a view showing an arranged configuration of blocks defined in the backlight unit of FIG. 2.
FIG. 5 is a view showing an example of the blocks in FIG. 4.

The backlight unit 80 can be divided into m×n blocks as shown in FIG. 4. Similarly, the divisional regions in a single frame may also be the same m×n as the blocks. In this case, "m" is a block number or a divisional region number in a horizontal direction and "n" is another block number or another divisional region number in a vertical direction.

For example, take the assumption that a single frame including 1920×1080 pixels is divided into 10 regions in the horizontal direction and 9 regions in the vertical direction, and that the 1920 pixel data in the horizontal direction are applied to the liquid crystal panel 50 through two ports. Then, each divisional region may include 120 (i.e., 1080/9) pixel data in the vertical direction and 96 (i.e., (1920/2)/10) pixel data in the horizontal direction. As such, one divisional region can include "120×96=11520" pixel data. Consequently, each of the 90 divisional regions may include "120×96=11520" pixel data.

Figure 6:
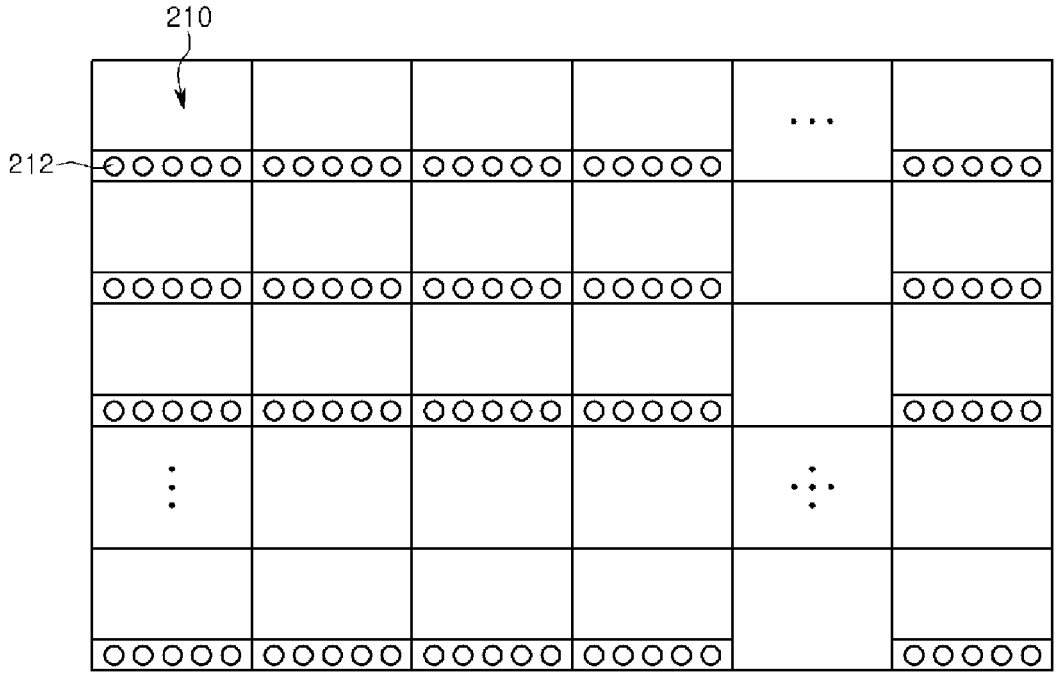
FIG. 6 is a view showing another example of the blocks in FIG. 4.

The plural blacks included in the backlight unit 80 can be configured as shown in FIG. 5 or 6.

The backlight unit 80, shown in FIG. 5, includes a plurality of blocks which each have a plurality of light emission diodes 202. The light emission diodes 202 involved in the same block respond to a same drive signal so that they emit lights of equal brightness. The light emission diodes 202 in the different blocks are driven by the different drive signals, thereby emitting lights of different brightness. Accordingly, each block can emit light in an optimized luminosity. The light emission diodes 202 in each block can be loaded on a package (not shown). In this case, the backlight unit 80 may include light emission diode packages which are arranged on the respective blocks.

On the other hand, a plurality of blocks involved in the backlight unit 80 each include: a light guide plate 210 guiding the light in a frontward direction (i.e., a direction perpendicular to its upper surface); and light emission diodes 212 loaded on a package (not shown) which is disposed parallel to a side of the light guide plate 210, as shown in FIG. 6. The light emission diodes 212 may be of a side emission type. In other words, the light emission diodes 212 may emit lights in sideward directions. Therefore, the lights emitted from the light emission diodes 212 on the package may enter into the light guide plate 210 and may progress toward the front direction (i.e., a direction perpendicular to the upper surface of the light guide plate 210) by means of the light guide plate 210.

Returning to FIG. 2, the backlight driver 70 generates drive signals corresponding to the respective third local dimming control signals (i.e., modulated local dimming control signals) applied from the third local dimming control signal generator 137 of the backlight controller 60. Also, the backlight driver 70 applies the drive signals to the respective blocks of the backlight unit 80. The drive signals may be a drive voltage or a drive current.

The light emission diodes 202 or 212 included in each of the blocks of the backlight unit 80 emit light of a luminosity (or brightness) corresponding to the drive signal which is applied from the backlight driver 30.

Sequentially, a method of driving the LCD device 10 as described above will now be explained.

The local brightness controller 120 of the backlight controller 60 divides single frame image data R, G, and B into the divisional regions corresponding to the blocks defined in the backlight unit 80, and calculates the mean values for the divisional regions. Also, the local brightness controller 120 selects the mean value of a divisional region which is the highest among the calculated mean values of the divisional regions as the maximum mean value of the divisional regions. Furthermore, the local brightness controller 120 generates the first local dimming control signals corresponding to the calculated mean values of the divisional regions.

The global brightness controller 100 of the backlight controller 60 calculates the global mean value for image data R, G, and B of a single frame. Also, the global brightness controller 100 generates the data modulation control signal by performing the arithmetic of the calculated global mean value and the maximum mean value of the divisional region selected in the local brightness controller 120, and applies the data modulation control signal to the data modulator 26 of the timing controller 20. Furthermore, the global brightness controller 100 generates the global dimming control signal from the data modulation control signal.

The local brightness controller 120 of the backlight unit 60 generates the second local dimming control signals for the divisional regions through the arithmetic of each of the obtained first local dimming control signals with the global dimming control signal applied from the global brightness controller 100. Sequentially, the local brightness controller 120 generates the third local dimming control signals for the divisional regions from the second dimming control signal, as the modulated local dimming control signals.

The data modulator 26 of the timing controller 20 generates the modulated data R', G', and B' from the image data R, G, and B by using the data modulation control signal applied from the global brightness controller 100 of the backlight controller 60. The data modulator 26 applies the modulated data R', G', and B' to the data driver 40.

The gate driver 30 responds to the first control signals applied from the controller 23 of the timing controller 20 and supplies the scan signal to each of gate lines on the liquid crystal panel 50.

The data driver 40 responds to the second control signals applied from the controller 23 of the timing controller 20 and supplies the analog data voltages each corresponding to the modulated data R', G', and B' applied from the data modulator 26 of the timing controller 20 to the data lines on the liquid crystal panel 50.

The backlight driver 70 supplies the drive signals each corresponding to the modulated local dimming control signals applied from the local brightness controller 120 of the backlight controller 60 to the backlight unit 80. As such, each block of the backlight unit 80 irradiates light in which a brightness is controlled on the liquid crystal panel 50.

In this manner, the modulated data R', G', and B', which is brightness-controlled by the backlight controller 60 and is obtained, as mentioned above, from single frame image data R, G, and B by using the data modulation control signal, is displayed on the liquid crystal panel 50. At the same time, light of controlled brightness from each of the regions corresponding to the defined blocks of the backlight unit 80 can be irradiated on the liquid crystal panel 50. Accordingly, a more defined image can be displayed.

Also, since a unified (or mixed) brightness control system combining the global and local brightness control systems is applied, the LCD device of the present embodiment improves brightness in a middle/high gray level range. Therefore, the LCD device can have a high contrast ratio and greatly reduce electric power consumption.

TABLE 1

| Brightness control system | Static C/R: Central area (0 gray level), Peripheral area (255 gray level) | Static C/R: Central area (255 gray scale, Peripheral area (0 gray level) | Dynamic C/R | Accumulated power consumption (Wh) | Decreased ratio of power consumption (%) |
|---|---|---|---|---|---|
| Normal (Related art) | 1436 | 1324 | 1430 | 40.88 | — |
| Local (Related art) | 3017 | 10505 | 59190 | 34.26 | 18.7 |
| Global (Related art) | 1446 | 1327 | 5428 | 36.59 | 13.2 |
| Local + Global (Present embodiment) | 2986 | 13993 | 118380 | 30.01 | 28.8 |

Static contrast ratios (static C/R), dynamic contrast ratios (dynamic C/R), and accumulated electric power consumption values have been experimentally obtained regarding each of the LCD devices of normal, global, local, and unified (local and global) brightness control systems.

Figure 7A:
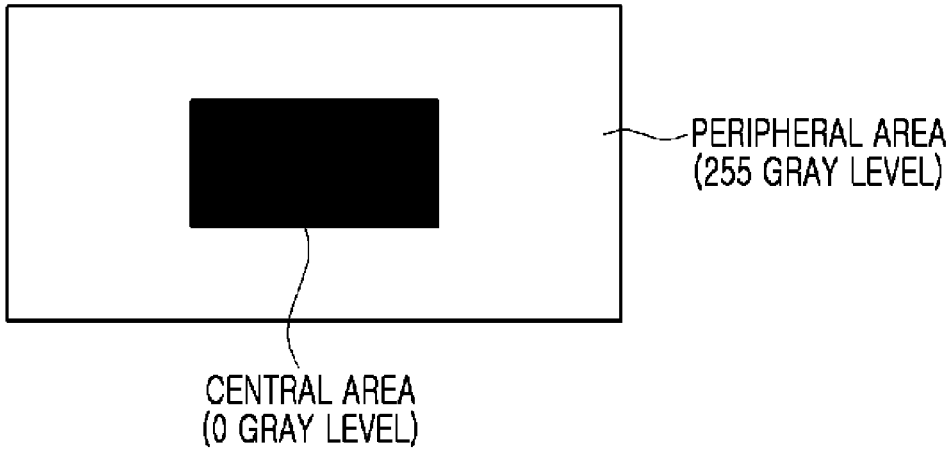
FIGS. 7A and 7B are views explaining a static contrast measuring method.
Figure 7B:
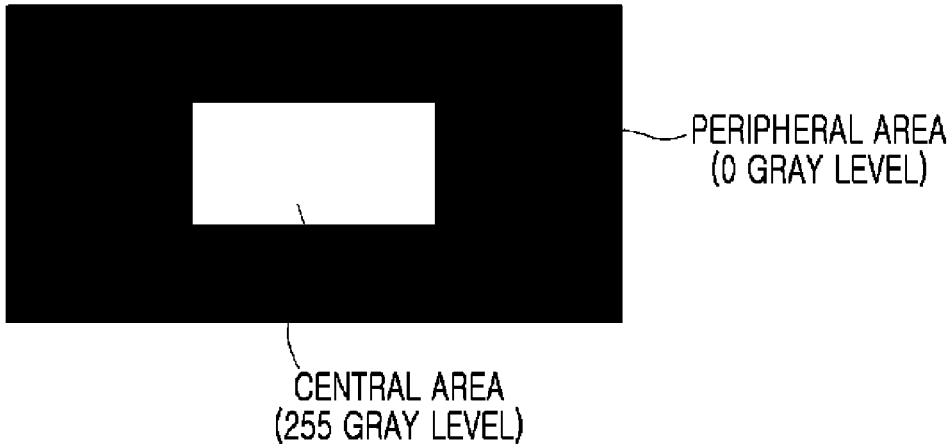

Static contrast ratio refers to a contrast ratio measured on the central and peripheral regions of the liquid crystal panel 50 when a single frame image is displayed. Dynamic contrast ratio corresponds to a contrast ratio measured when a single frame image of all black is displayed on the liquid crystal panel 50 and when a single frame image of all white is displayed on the liquid crystal panel 50. The static contrast ratios have been measured when the central and peripheral areas of the liquid crystal panel 50 are displayed in "0" and "255" gray levels as shown in FIG. 7A, and when the central and peripheral areas of the liquid crystal panel 50 are displayed in "255" and "0" gray levels as shown in FIG. 7B, respectively.

As seen in Table 1, it is evident that the unified local-global brightness control system of the present embodiment has a very high contrast ratio in comparison with those of the normal, local, and global brightness control systems of the related arts. More specifically, the contrast ratio of the unified local-global brightness control system according to the present embodiment is two times higher than those of the normal and global brightness control systems when the central and peripheral areas of the liquid crystal panel 50 are displayed in "0" and "255" gray levels, respectively. Furthermore, when the central and peripheral areas of the liquid crystal panel 50 are displayed in "255" and "0" gray levels, respectively, the contrast ratio of the unified local-global brightness control system according to the present embodiment is ten times higher than those of the normal and global brightness control systems With regards to the dynamic contrast ratios, the unified local-global brightness control system of the present embodiment is much higher than the normal, local, and global brightness control systems. In other words, brightness for black in the unified local-global brightness control system of the present embodiment is measured in "0" and the contrast ration becomes infinite. However, the contrast ratio of the unified local-global brightness control system according to the present embodiment has a value of "118380 due to a measuring error of "0.005". Such a contrast ratio of the unified local-global brightness control system according to the present embodiment is about 20 to 100 times higher than those of the normal, local, and global brightness control systems according to the related arts.

Also, the decreased rate of accumulated electric power consumption of the unified local-global brightness control system of the present embodiment is much larger than the rates of the normal, local, and global brightness control systems according to the related arts.

Consequently, as seen in the experimental figures, the unified local-global brightness control system of the present embodiment can greatly improve the static and dynamic contrast ratios and decrease the rate of electric power consumption, in comparison with the normal, local, and global brightness control systems of the related arts.

As described above, the LCD device according to an embodiment of the present disclosure employs a unified system of the local and global brightness control systems. The static and dynamic contrast ratios and the decreased rate of electric power consumption in the LCD device of the present embodiment may be greatly improved in comparison with those in the LCD devices of the normal, local, and global brightness control systems according to the related arts.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device comprising:

a liquid crystal panel including a plurality of pixels arranged in a matrix;

a backlight unit divided into a plurality of blocks;

a global brightness controller that generates a data modulation control signal using a single frame image data to be displayed on the liquid crystal panel;

a local brightness controller that generates a plurality of modulated local dimming control signals for a plurality of divisional regions divided from the single frame image data;

a data modulator that generates a modulated data from the single frame image data by using the data modulation control signal, and supplies the modulated data to the liquid crystal panel; and a backlight driver that supplies the blocks of the backlight unit with a plurality of driver signals which correspond to the plurality of modulated local dimming control signals, respectively, wherein the plurality of divisional regions correspond to the plurality of blocks, respectively, wherein the global brightness controller includes a global mean calculator that produces a global mean value for a plurality of pixels included in the single frame image data;

a data modulation control signal generator that generates the data modulation control signal using the global mean value; and a global dimming control signal generator that generates a global dimming control signal corresponding to the data modulation control signal, wherein the local brightness controller includes a region divider that divides the single frame image data into the plurality of divisional regions;

a local mean calculator that averages the plural pixel data included in each of the divisional regions to generate a plurality of local mean values for the divisional regions;

a maximum region selector that selects a divisional region having the maximum mean value among the local mean values for the plural divisional regions;

a first local dimming control signal generator that generates a plurality of first local dimming control signals each corresponding to the local mean values of the divisional regions;

a second local dimming control signal generator that generates a plurality of second local dimming control signals for the divisional region from the global dimming control signal and the first local dimming control signals for the divisional region; and a third local dimming control signal that generates a plurality of third local dimming control signals, for the divisional regions, corresponding to the respective second local dimming control signals for the divisional regions.

2. The liquid crystal display device according to claim 1, wherein the third local dimming control signals are the modulated local dimming control signals.

3. The liquid crystal display device according to claim 1, wherein the data modulation control signal is obtained by dividing the global mean value applied from the global mean calculator with the maximum mean value applied from the maximum region selector.

4. The liquid crystal display device according to claim 1, wherein the second local dimming control signals are obtained by applying the logic-AND operation to the global dimming control signal and each of the first local dimming control signals.

5. The liquid crystal display device according to claim 1, further comprising:

a first storage connected to the global dimming control signal generator and including a first dimming curve which has a correlation between the global dimming control signal and the data modulation control signal;

a second storage connected to the first local dimming control signal generator and including a second dimming curve which has a correlation between the local mean value and the first local dimming control signal; and a third storage connected to the third local dimming control signal generator and including a third dimming curve which has a correlation between the second local dimming control signal and the third local dimming control signal.

6. The liquid crystal display device according to claim 1, wherein the modulated data is increased or decreased according to the data modulation control signal.

7. A method of driving a liquid crystal display device including a liquid crystal panel with a plurality of pixels arranged in a matrix and a backlight unit divided into a plurality of blocks, the method comprising:

generating a data modulation control signal using single frame image data to be displayed on the liquid crystal panel;

generating a plurality of modulated local dimming control signals for a plurality of divisional regions of the divided single frame image data;

generating a modulated data from the single frame image data by using the data modulation control signal, and applying the modulated data to the liquid crystal panel; and supplying the blocks of the backlight unit with a plurality of driver signals which correspond to the plurality of modulated local dimming control signals, respectively, wherein the plurality of divisional regions correspond to the plurality of blocks, respectively, wherein the generation of a data modulation control signal includes, producing a global mean value for a plurality of pixels included in the single frame image data;

generating the data modulation control signal using the global mean value; and generating a global dimming control signal in correspondence with the data modulation control signal, wherein the generation of a plurality of modulated local dimming control signals includes, dividing the single frame image data into the plural divisional regions;

averaging the plural pixel data included in each of the divisional regions to produce a plurality of local mean values for the divisional regions;

selecting a divisional region having the highest mean value among the local mean values for the plural divisional regions;

generating a plurality of first local dimming control signals each corresponding to the local mean values of the divisional regions;

deriving a plurality of second local dimming control signals for the divisional region from the global dimming control signal and the first local dimming control signals for the divisional region; and generating a plurality of third local dimming control signals, for the divisional regions, in correspondence with the respective second local dimming control signals for the divisional regions.

8. The method according to claim 7, wherein the third local dimming control signals are the modulated local dimming control signals.

9. The method according to claim 7 wherein the data modulation control signal is obtained by dividing the global mean value with the maximum mean value.

10. The method according to claim 7 wherein the second local dimming control signals are obtained by applying the logic-AND operation to the global dimming control signal and each of the first local dimming control signals.

11. The liquid crystal display device according to claim 7, wherein the modulated data is increased or decreased according to the data modulation control signal.

* * * * *